United States Patent [19]

Leliaert et al.

[11] 4,207,711

[45] Jun. 17, 1980

[54] AIRLESS CENTRIFUGAL BLAST DEVICE

[75] Inventors: Raymond M. Leliaert, South Bend; Richard C. Kanouse; Bill J. Butler, both of Mishawaka; Robert N. Linder, Granger, all of Ind.

[73] Assignee: Wheelabrtor-Frye Inc., Hampton, N.H.

[21] Appl. No.: 909,770

[22] Filed: May 26, 1978

[51] Int. Cl.[2] ..... B24C 3/02; B24C 7/00

[52] U.S. Cl. ..... 51/432

[58] Field of Search ..... 51/431, 432, 434, 435; 241/275; 72/40, 53

[56] References Cited

U.S. PATENT DOCUMENTS

| | | | |
|---|---|---|---|
| 250,446 | 4/1943 | Grocholl . | |
| 2,131,143 | 9/1938 | Quinn | 51/432 |
| 2,204,637 | 6/1940 | Unger | 51/432 |
| 2,363,437 | 11/1944 | Peterson | 51/432 |

FOREIGN PATENT DOCUMENTS

| | | | |
|---|---|---|---|
| 538349 | 11/1931 | Fed. Rep. of Germany | 51/432 |
| 1015343 | 9/1957 | Fed. Rep. of Germany | 51/431 |
| 522676 | 4/1955 | Italy | 51/431 |
| 117608 | 11/1926 | Switzerland | 51/432 |
| 319278 | 10/1930 | United Kingdom | 51/429 |
| 238368 | 7/1969 | U.S.S.R. | 51/432 |

*Primary Examiner*—Gary L. Smith

*Attorney, Agent, or Firm*—McDougall, Hersh & Scott

[57] ABSTRACT

An airless centrifugal blast device in the form of a one piece, two-bladed wheel mounted for rotational movement about either a horizontally or vertically disposed axis and means for off center gravitational feed of particulate media to the inner end portions of the blades with the particulate media feed tube means tapering in cross section to the discharge opening and extension of the discharge opening in the direction of rotation of the wheel.

15 Claims, 10 Drawing Figures

AIRLESS CENTRIFUGAL BLAST DEVICE

This invention relates to airless abrasive blast wheels for projecting metallic and non-metallic particulate media for impact upon surfaces in such processes as shot peening, descaling, deburring, and other abrasive blast applications.

The invention will be described with reference to a simple wheel formed of two blades extending diametrically in opposite directions from a central hub mounted on a motor driven, belt driven, or the like shaft for rotational movement about a central axis of the shaft. A centrifugal two-bladed airless blast wheel of the type described is marketed in this country under the name Delta type wheel. Features of this invention, such as the novel concepts for feeding the particulate media to the wheel, as will hereinafter be described, have applications to other types of single or multiple bladed wheels, wherein the particulate media is introduced for engagement with the inner portion of the blade surface for projecting from the ends thereof in response to centrifugal force imparted by rotation of the blades at h igh speed about the central axis.

Delta type wheels of the type heretofore produced have been found to be deficient in a number of respects. Blade change to replace worn out blades has been awkward and sometimes very difficult, and the mounted blades are inadequately supported on the central shaft. Further, the assembly is subject to vibrations, which bring about increased wear and reduction in strength of the assembly.

The feed from the tubes used to introduce the particulate media into the path of the blades provides for an erratic flow rate which not only reduces the output efficiency of the wheel but results in lack of control of the blast pattern.

It is an object of this invention to provide an improved airless blast wheel and feed means which are characterized by:

(1) greater stability and less vibration in use;
(2) greater strength;
(3) ease in replacement of parts;
(4) control of the blast pattern with means to increase the length of the pattern;
(5) greater stability and distribution of the blast pattern;
(6) control of the flow rate of the particulate media and the power utilized by the wheel to project a selected flow rate of particulate media; and
(7) improved means for feeding particulate media for increased flow rate and increase in the lengths of the blast pattern, with corresponding increase in the output efficiency of the wheel.

These and other objects and advantages of this invention will hereinafter appear, and for purposes of illustration, but not of limitation, an embodiment of the invention is shown in the accompanying drawings, in which.

Figure 1:
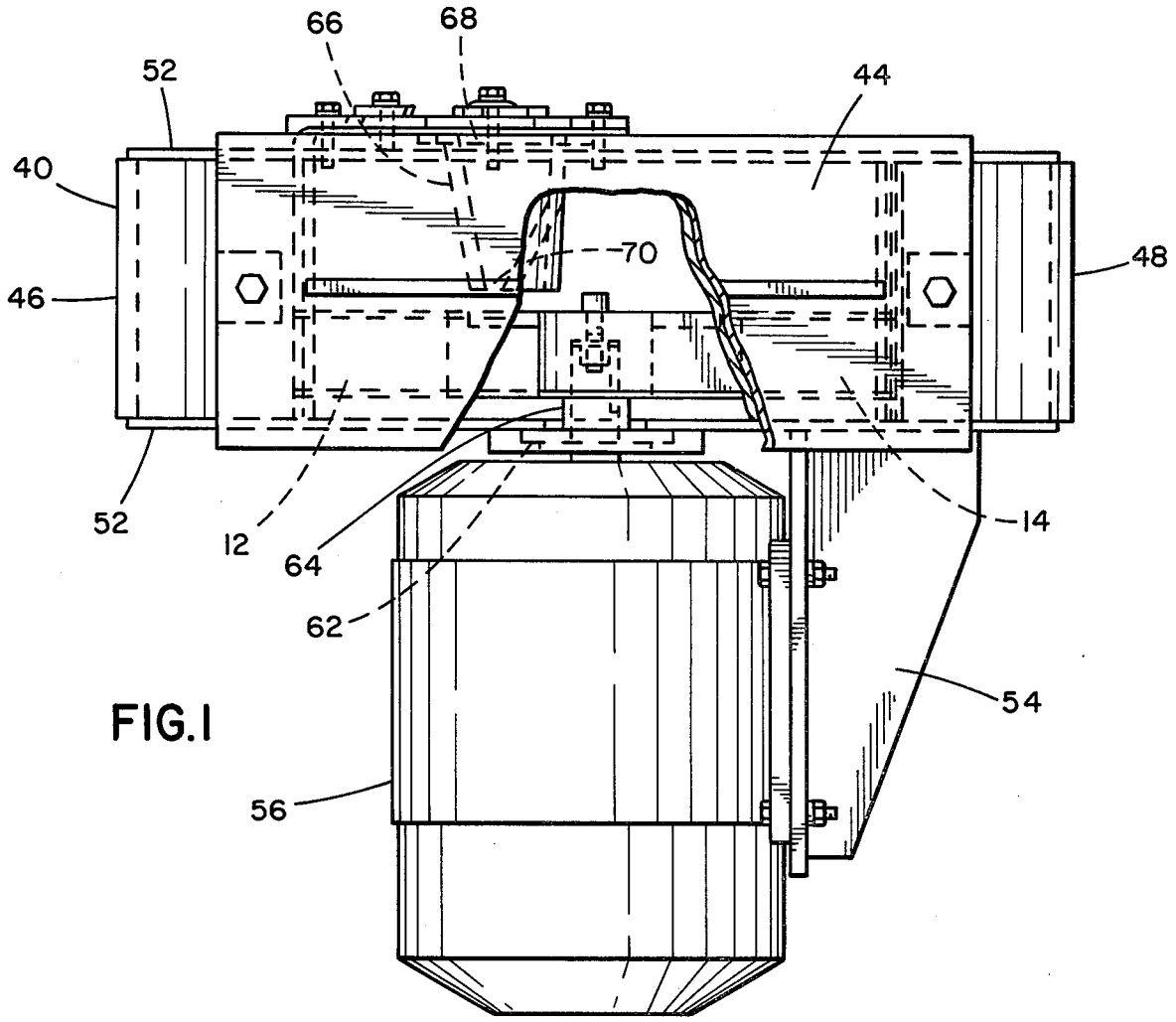
FIG. 1 is a side elevatinal view of a wheel assembly embodying the features of this invention, with portions broken away to show elements in the interior thereof.

Referring now to FIGS. 3 to 7 of the drawings, illustration is made of the two-bladed wheel of this invention comprising a central hub 10 and a pair of blades 12 and 14 extending outwardly in parallel relation in opposite directions from the hub 10, from portions of the hub on opposite sides of the axis and spaced from the axis by an equal amount to provide a balanced wheel.

The two-bladed wheel is mounted for movement about an axis by means of a bushing 16 which is received in fitting relation within an axial bore 18 through a portion of the hub and which, in turn, is mounted on the end of a motor driven shaft 20 which extends through an axial opening 22 in the hub in contiguous relation with the bore 18. The bushing is provided with a key 24 adapted to be received in fitting relationship within a keyway 26 in the hub for replaceably mounting the two-bladed wheel on the bushing for rotational movement therewith.

Figure 2:
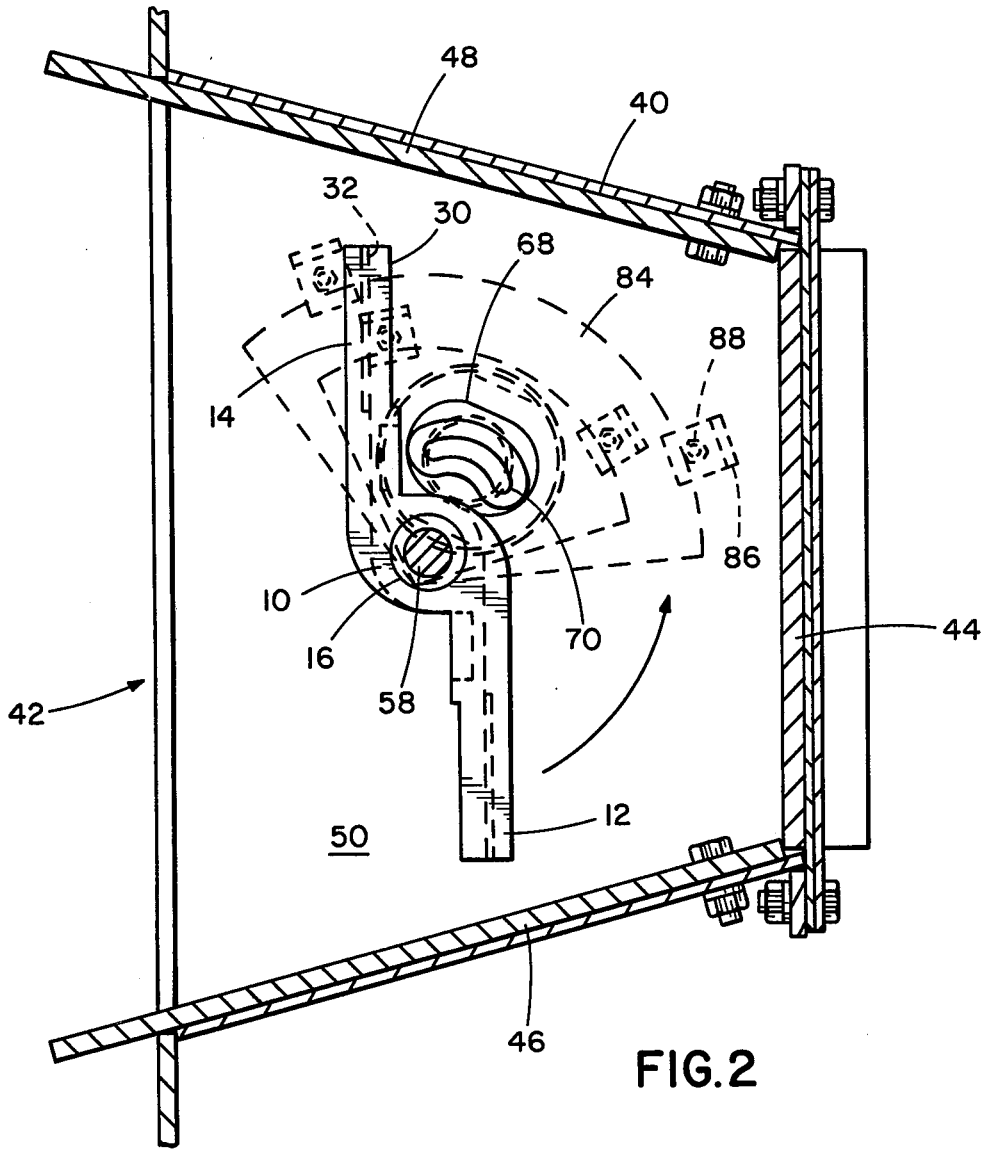
FIG. 2 is a sectional view taken along line 2—2 of FIG. 1.
Figure 10:
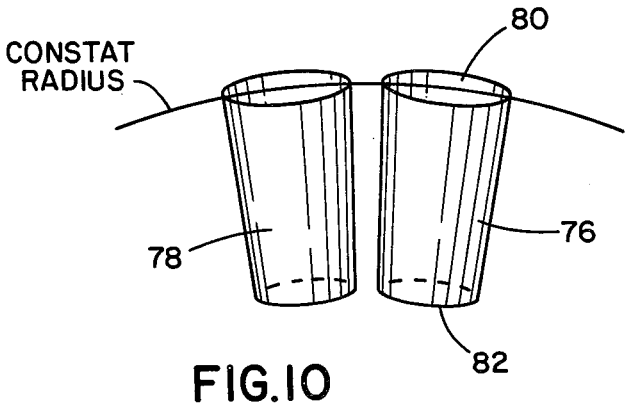
FIG. 10 is a perspective view of a further modification in a feed tube embodying the features of this invention.
Figure 3:
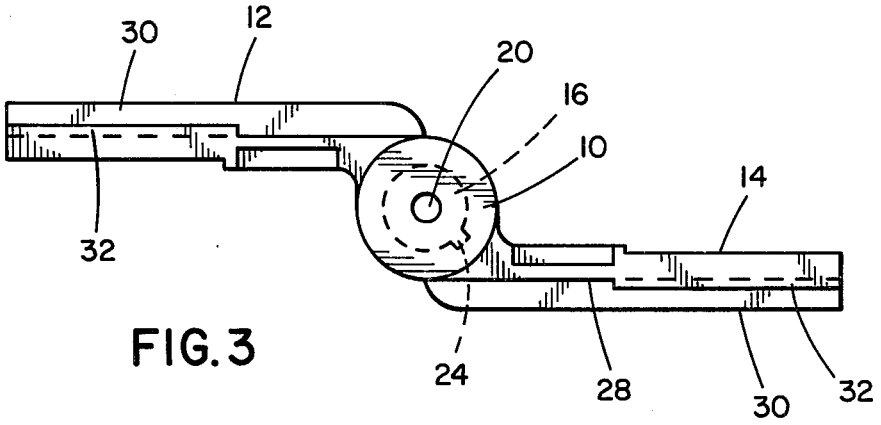
FIG. 3 is a top plan view of the two-bladed wheel shown in FIG. 1.
Figure 4:
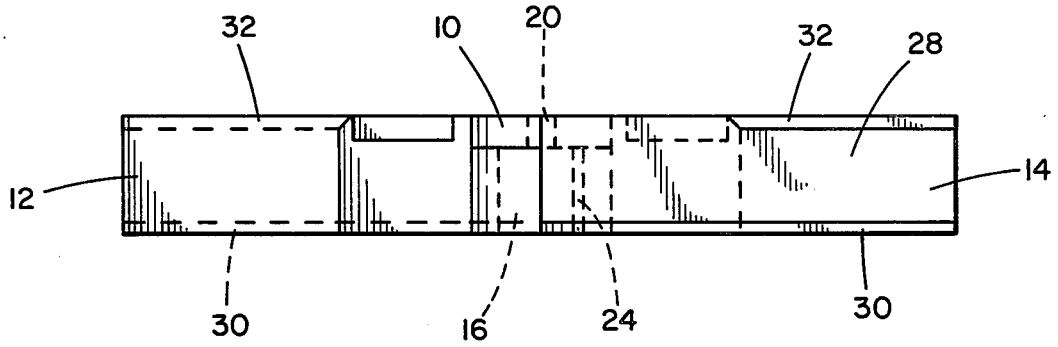
FIG. 4 is a side elevational view of the two-bladed wheel of FIG. 3.
Figure 5:
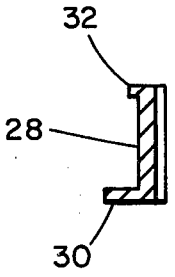
FIG. 5 is a sectional view taken along the line 5—5 of FIG. 4.
Figure 6:
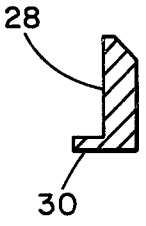
FIG. 6 is a sectional view taken along the line 6—6 of FIG. 4.
Figure 7:
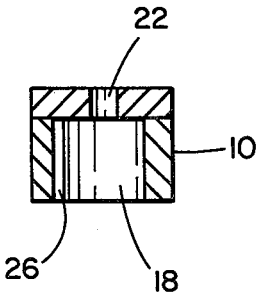
FIG. 7 is a sectional view taken along the line 7—7 of FIG. 4.

The surfaces 28 of the blades 12 and 14, facing in the direction of rotational movement, indicated by the arrow in FIG. 2, constitute the front face adapted to engage the particulate media and over which the particulate media is displaced outwardly for projection from the ends of the blades in response to rotational movement of the wheel at high speed.

The front face 28 of each blade 12 and 14 is formed with a rib 30 which projects from the front face along the lower edge substantially throughout the length thereof. A similar rib 32 of lesser depth extends from the upper edge of the front face substantially throughout the length thereof except for a short inner section adjacent the hub 10 in circumferential alignment with the outlet from the feed tube through which particulate media flow gravitationally into the path of the inner end portion of the blades for engagement thereby during rotational movement of the wheel.

In the preferred practice of this invention, the two-bladed wheel is formed in one piece to enable easier assembly while providing a stronger wheel which remains well balanced during use and thereby to provide for greater stability and less vibration during operation.

The blades 12 and 14 are usually straight members of rectangular shape having a width within the range of 1.5–4 inches and a length with in the range of 3–10 inches. The ribs or flanges 30 and 32 operate to confine the particulate media for travel along the face of the blade and to minimize stray of particulate media over the edges of the blades.

As illustrated in FIGS. 1 and 2, the two-bladed wheel is mounted within a shroud 40 having an open side 42 through which particulate media is projected by the wheel. In the illustrated modification, the shroud is of trapezoidal shape with a back wall 44, angularly extending side walls 46 and 48 and trapezoidally shaped bottom and top walls 50.

A bracket 54 mounts an electric motor 46 from the bottom wall 50 of the shroud with the shaft 58 of the motor extending through the bottom wall for receipt of the bushing 16 on the through extending portion thereof and which is adapted to be secured thereon, as by means of a cap screw 60. A rubber seal 62 is provided between the motor housing and the bottom wall 50 of the shroud and a sealing gasket 64 is provided about the shaft portion extending through the bottom wall for protection from the abrasive media.

An important concept of this invention also resides in the configuration of the feed tube through which the particulate media is fed to the wheel. In the past, use has been made of a tubular member of uniform cross section extending from the end of a hopper to a level which just clears the upper edge of the blades.

Because of the increasing velocity of the particulate media as it falls gravitationally downwardly through the feed tube, particulate media which fills the tube at the inlet only partially fills the tube at the outlet. It has been found that when the discharge end of the tube is only partially filled, erratic patterns result from the wandering action of the particulate media out of the feed tube.

The following tabulation gives the velocity and the density determinations made with the same particulate media for various lengths of fall through a feed tube having a 1.5 inch orifice and from an initial velocity of 92 ft./min. and a K factor for the friction of the tube walls of 0.5.

| Distance of Fall | Velocity out of Discharge End of Tube | Exit Density out of Tube |
|---|---|---|
| 3" | 193.5 ft/min | 47.5% |
| 6" | 257.7 ft/min | 35.7% |
| 9" | 308.9 ft/min | 29.8% |
| 12" | 352.7 ft/min | 26.1% |
| 24" | 490.2 ft/min | 18.8% |

The erratic action has been overcome, in accordance with the practice of this invention, by the use of a feed tube of a configuration which diminishes in cross section from the inlet end to the discharge end whereby the density of the particulate media at the discharge end is at substantially maximum density. This provides for a smooth feed of particulate media at a uniform rate which calculates out to be a maximum rate with corresponding improvement in the pattern of the blast.

It has also been found that the pattern thrown by the blades can be markedly lengthened to provide for greater coverage and more efficient operation by configuration of the discharge from the feed tube to lengthen the discharge of particulate media somewhat in the direction of rotation of the blades. This has the effect of increasing the time of flow of particulate media onto the face of the blade with a resultant longer particulate blast pattern. In other words, the same inner area of the blade is adapted to engage successive amounts of particulate media during its rotational movement thereby to increase the length of the blade covered by particulate media during any one instant, with corresponding increase in the angle for projection of the particulate media from the blade.

Figure 8:
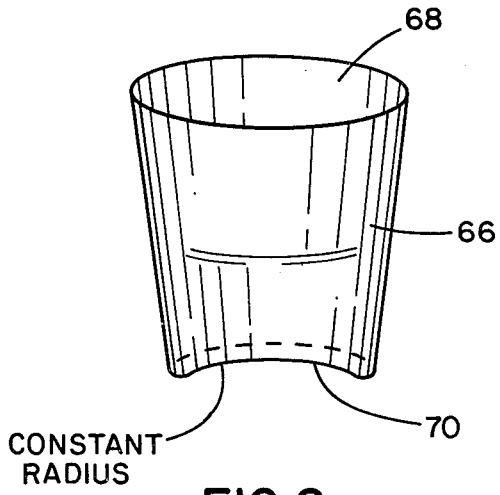
FIG. 8 is a perspective view of a feed tube embodying the features of this invention.

As illustrated in FIGS. 1, 2 and 8, the preferred configuration is a feed tube 66 which tapers inwardly from the entrace end 68 to the discharge end 70 with the discharge end defining an orifice of crescent shape arranged to extend circumferentially to the axis of rotation of the wheel or to extend lengthwise in the direction of rotation of the blade.

Figure 9:
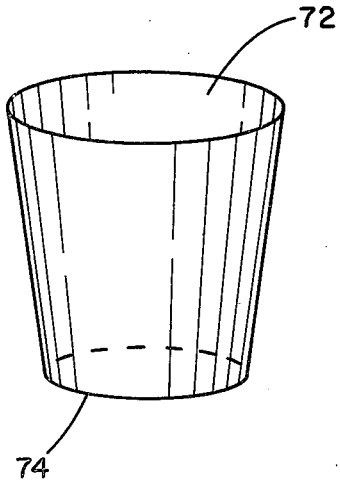
FIG. 9 is a perspective view of a modification in a feed tube embodying the features of this invention.

Instead, the desired effect can be obtained with a feed tube of the type shown in FIG. 9, in which the feed tube tapers inwardly from the inlet end 72 to the discharge end 74 with the outlet opening at the discharge end being of oblong or other geometric shape with the major dimension extending in the direction circumferentially of the axis or in the direction of rotation of the blade.

By way of a further ramification, the feed tube can be formed of two or more separate tubular members 76 and 78 of circular or polygonal cross section, each of which tapers inwardly from their inlet end 80 to the discharge 82 with the tubular members arranged circumferentially with respect to the axis of the wheel to discharge particulate media at variable distances from the blade for continuous engagement by the blade over a period of time during its rotational movement.

These arrangements have the effect of making increased use of the blade thereby to increase the output of the wheel while, at the same time, increasing the area covered by the abrasive blast.

As illustrated in FIGS. 1 and 2, the feed tube 66 extends through an opening in the top plate of the shroud to a level immediately above the upperinner edge of the blade. The feed tube is supported by a plate 84 that is fastened to the top surface of the top plate, as by means of lock washers 86 held down by cap screws 88. Particulate media is fed to the inlet of the feed tube 66 from a hopper (not shown) in communication therewith for gravity flow of particulate media from the hopper into the feed tube.

In operation, the wheel is rotated at high speed. The article to be treated by particulate media thrown from the wheel is positioned in front of the open side 42 of the shroud. Particulate media which falls from the discharge end of the tube 66 is engaged by the face of the blades rotating at high speed. Upon engagement with the face of the rotating blades, the particulate media is centrifugally displaced over the face of the blade and is thrown with high centrifugal force from the ends thereof, through the open side 42 onto the article in front thereof.

It will be understood that the wheel shaft can be driven in rotational movement by conventional means other than an electrical motor, for example, as by an internal combustion engine, magnetic drive, or by indirect belt or gear drive. Similarly, the shroud can vary in shape as long as it substantially encloses the wheel except for the open side wall for projection of the particulate media therethrough. The wheel can be mounted for rotational movement about a vertical axis or a horizontal axis or any angle in between.

The wheel assembly described constitutes a low cost airless blast device which is easy to operate and which utilizes minimum space and supporting equipment. The spent abrasive or other particulate media can be recovered in the usual manner for reuse, preferably after removing dust and dirt as by means of a screen, air wash, and/or magnetic separator.

When it is desired to remove the wheel for replacement or repair, it is only necessary to remove the wheel from the shaft, with or without the bushing, and to replace the wheel by reversal of the operation.

It will be understood that changes may be made in the details of construction, arrangement and operation, without departing from the spirit of the invention, especially as defined in the following claims.

We claim:

1. A device for airless blast with particulate media comprising wheel blades, means for feeding particulate media by gravitational flow to the inner end portions of the wheel blades for engagement by the blades during rotational movement of the wheel at high speed whereby the engaged particulate media is projected from the ends of the blades comprising a tubular member having an inlet opening at the top and a discharge opening at the bottom, aligned with the inner end portion of the blades, at a level which just clears the upper edge of the blades, with the tubular member decreasing in cross section from the inlet at the top to the discharge opening at the bottom end in which the discharge opening has a lengthwise dimension in the direction of rotation of the wheel greater than the crosswise dimension whereby the time of flow of media onto the face of the blades is increased thereby to increase the length of the coverage of the material thrown from the outer ends of the blades.

2. A feed means as claimed in claim 1, in which the discharge opening is of crescent shape with the lengthwise dimension extending in the direction of rotation of the wheel.

3. A feed means as claimed in claim 1, in which the discharge opening is of oblong shape with the major dimension in the direction of rotation of the wheel.

4. A feed means as claimed in claim 1, in which the means for extending the discharge opening in the direction of rotation of the wheel comprises two or more separate tubular members arranged with their discharge openings aligned in the direction of rotation of the wheel.

5. A device for airless blast with particulate media comprising a housing having a horizontally disposed bottom wall and a top wall and an open side, a wheel having a pair of elongate blades extending continuously radially outwardly in opposite directions from the central axis of the wheel to between the top and bottom walls for rotational movement relative thereto about a central vertical axis, said blades being supported only at their inner end portions to constitute the only structure extending between said top and bottom walls, means for imparting rotational movement to the wheel, a feed tube extending downwardly from an opening through the top wall to a level immediately above the upper edge of the wheel blades and in circumferential alignment with an inner end portion thereof but offset from the central axis, and means for feeding particulate media to the feed tube for passage through the feed tube into the path of the inner end portion of the wheel blades during their rotational movement whereby the engaged particulate media is displaced centrifugally over the face of the blades and projected from the blades through the open side.

6. A device as claimed in claim 5, in which the two-bladed wheel comprises a central hub, a pair of blades extending in opposite directions from opposite side portions of the hub offset an equal distance from the axis of the hub.

7. A two-bladed wheel as claimed in claim 6, in which the wheel is a one piece wheel.

8. A two-bladed wheel as claimed in claim 6, in which the blades extend tangentially in opposite directions from diametrically opposed sides of the hub.

9. A two-bladed wheel as claimed in claim 6, in which the blades extend in spaced parallel planes.

10. A two-bladed wheel as claimed in claim 6, in which the blades have a front face and a back wall and which includes a flanged portion extending perpendicularly from the lower edge portion of the front face substantially throughout the length of the blade and a flanged portion extending perpendicularly from the upper edge portion of the front face from an inner end spaced a short distance from the hub to the outer end.

11. A device as claimed in claim 5, in which the means for imparting rotational movement to the wheel within the housing comprises a shaft which extends through the bottom wall of the housing, means for removably mounting the hub of the wheel onto the through extending portion of the shaft for conjoint rotational movement and means for imparting rotational movement to the shaft.

12. A device for airless blast with particulate media comprising a housing having a horizontally disposed bottom wall and a top wall and an open side, a two-bladed wheel mounted within the housing between the top and bottom walls for rotational movement relative thereto about a central vertical axis, means for imparting rotational movement to the wheel, a feed tube extending downwardly from an opening through the top wall to a level immediately above the upper edge of the wheel blades and in circumferential alignment with an inner end portion thereof but offset from the central axis, and means for feeding particulate media to the feed tube for passage through the feed tube into the path of the inner end portion of the wheel blades during their rotational movement whereby the engaged particulate media is displaced centrifugally over the face of the blades and projected from the blades through the open side, in which the means for feeding particulate media comprises a tubular member having an inlet opening at the top and a discharge opening at the bottom, aligned with the inner end portion of the blades, at a level which just clears the upper edge of the blades, with the tubular members decreasing in cross section from the inlet opening at the top to the discharge opening at the bottom and in which the discharge opening has a lengthwise dimension in the direction of rotation of the wheel that is greater than the crosswise dimension whereby the time of flow of media onto the face of the blades is increased thereby to increase the length of the coverage of the material thrown from the outer ends of the blades.

13. A device as claimed in claim 12, in which the discharge opening is of crescent shape with the lengthwise dimension extending in the direction of 14. A device as claimed in claim 12, in which the discharge opening is in the shape of an oblong with the major dimension in the direction of rotation of the wheel.

15. A device as claimed in claim 12, in which the means for extending the discharge opening in the direction of rotation of the wheel comprises two or more separate tubular members arranged with their discharge openings aligned in the direction of rotation of the wheel.

* * * * *

UNITED STATES PATENT OFFICE

CERTIFICATE OF CORRECTION

Patent No. 4,207,711 Dated June 17, 1980

Inventor(s) Raymond M. Leliaert et al.

It is certified that error appears in the above-identified patent and that said Letters Patent are hereby corrected as shown below:

Col. 6, line 55, at the end of the line insert
-- rotation of the wheel -- .

Signed and Sealed this

*Ninth* Day of *September 1980*

[SEAL]

*Attest:*

SIDNEY A. DIAMOND

*Attesting Officer*

*Commissioner of Patents and Trademarks*